US005596775A

United States Patent [19]

DiMatteo et al.

[11] Patent Number: 5,596,775

[45] Date of Patent: Jan. 28, 1997

[54] PATIENT TRANSFER SEAT

[75] Inventors: Paul DiMatteo, Dix Hills; Charles Chubb, Brookville, both of N.Y.

[73] Assignee: Nova Techologies, Inc., Hauppauge, N.Y.

[21] Appl. No.: 380,900

[22] Filed: Jan. 30, 1995

Related U.S. Application Data

[63] Continuation-in-part of Ser. No. 183,094, Jan. 18, 1994, Pat. No. 5,535,459.

[51] Int. Cl.[6] ..... A61G 7/10

[52] U.S. Cl. ..... 5/81.1 C; 5/81.1 R; 5/600; 297/335

[58] Field of Search ..... 5/81.1, 86.1, 600, 5/83.1; 297/DIG. 10, 335, 336, 332

[56] References Cited

U.S. PATENT DOCUMENTS 2,676,643 4/1954 Miller et al. ..... 5/81.1 X
4,632,450 12/1986 Holdt ..... 5/81.1 X
4,821,352 4/1989 DiMatteo et al. ..... 5/81.1
5,127,113 7/1992 DiMatteo et al. ..... 5/81.1
5,333,887 8/1994 Luther ..... 5/81.1 X

*Primary Examiner*—Michael F. Trettel
*Attorney, Agent, or Firm*—Patterson, Belknap, Webb & Tyler, LLP

[57] ABSTRACT

A patient transfer chair is disclosed which can be manually operated preferably by using a lever and spring helping device to assist in the transfer of a patient to and from a bed to and a wheelchair, chair, or other seat design. In transferring a patient from a chair to a bed, the lever is used by an attendant to assist the patient back and onto a transfer bed device. A spring helping device can be optionally used to assist in the transfer. Accordingly, a substantial reduction in the costs to design, manufacture, and operate a transfer chair is achieved while maintaining the same degree of comfort, safety and ease of prior patient transfer system designs.

15 Claims, 12 Drawing Sheets

PATIENT TRANSFER SEAT

This is a continuation-in-part of a U.S. patent application Ser. No. 08/183,094 filed on Jan. 18, 1994, now U.S. Pat. No. 5,535,459, which is hereby incorporated by reference.

BACKGROUND OF THE INVENTION

1. Field of the Invention

The present invention is directed to patient transfer systems and, more particularly, to transferring a patient to and from a bed and a chair, wheelchair, commode, or other seat.

2. Description of the Prior Art

The process of transferring an invalid person to and from a bed and a chair often requires the help of two or more assistants. The task frequently requires considerable strength and is a common source of injury to the person being transferred or to an attendant doing the transfer or both. These transfer problems are often the major reason for requiring a patient to be hospitalized or moved to a nursing home, rather than being cared for at home, and then, in many cases, increase the cost of caring for persons in hospitals and nursing homes. Further, invalid persons can easily be injured when they are being transferred between a bed and a wheelchair, due to such causes as stresses placed on weak bones, decubitus ulcers, or as a result of accidental falling.

Prior designs, for example those shown and described in U.S. Pat. Nos. 4,726,082, 4,797,960, 4,819,283, 5,127,113, and 5,319,813, and other patents assigned to Nova Technologies, Inc., describe various novel arrangements for transferring an invalid person to and from a bed and a separate wheelchair, chair, commode, or other seat by means of a transfer sheet rolled up on a roller at the foot of the bed, pulled over the bed mattress, and unrolled from a roller at the head of the bed. These prior designs solve the problems associated with patient transfer. However, there is a continuing need to reduce the complexity and costs associated with the design, manufacture, and operation of patient transfer systems while still maintaining the comfort, safety and ease associated with prior designs.

Accordingly, it is an object of the present invention to provide a special wheelchair, chair, or other seat design, and a bed equipped with rollers, a transport sheet, and a lifting mechanism, so that a person can be comfortably transported over the bed and partially onto the horizontal seat of the wheelchair or chair and then raised to a normal sitting position thereon, with no effort on the part of the invalid person and requiring only moderate physical strength or skill on the part of an attendant.

It is another object of this invention to provide a comfortable and safe method of transfer with minimum stress on the person's body and minimum sliding action which could cause injury or aggravate the person.

It is another object of the present invention to provide a simpler arrangement which can provide substantially the same degree of comfort, safety and ease of prior patient transfer systems at significantly lower cost for design, manufacture, and operation.

SUMMARY OF THE INVENTION

The above and other objects are met by the present invention whereby a patient transfer chair can be manually operated preferably by using a lever to assist in the transfer of a patient from a bed to a wheelchair, chair, or other seat design. In transferring a patient from a seat to a bed, the lever is used by an attendant to assist a patient back and onto a transfer bed device. A spring helping device can be optionally used to assist in the transfer. Accordingly, a substantial reduction in the costs to design, manufacture, and operate a transfer seat is achieved while maintaining the same degree of comfort, safety and ease of prior patient transfer system designs.

BRIEF DESCRIPTION OF THE DRAWINGS

Preferred embodiments of the patient transfer chair of the present invention are described in detail below with reference to the drawings wherein.

DETAILED DESCRIPTION OF THE PREFERRED EMBODIMENTS

The operation of a simplified patient transfer system of the present invention is shown in FIGS. 1*a* through 1*h*.

Figure 1A:
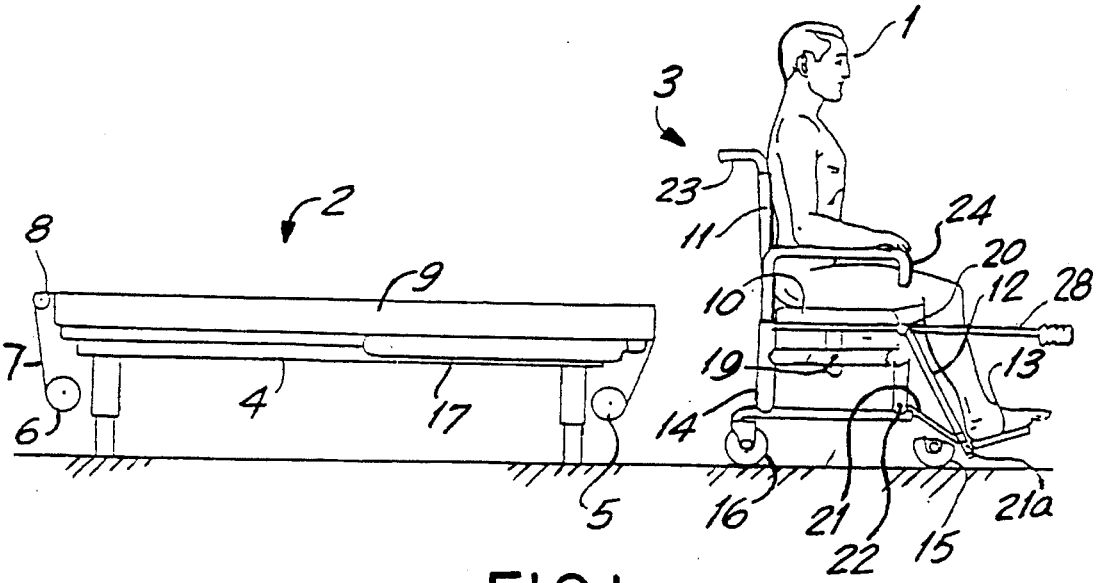
FIGS. 1*a* through 1*h* are schematic sequential views of an embodiment of the invention showing the transfer of a person between a wheelchair and a bed.

FIG. 1*a* shows a person 1 seated in a wheelchair 3 ready to be transferred to a transfer bed 2. Transfer bed 2 consists of a conventional bed 4, as found in a home or institution such as a nursing home or hospital, having a mattress 9 and other modifications as to be described. The bed is presumed to be adjusted by conventional means (not shown) to the proper height to perform the required operations, that is, to a level substantially even with the seat of the wheelchair.

Attached to the bed 4 is a known arrangement for transporting a person longitudinally across the bed. This arrangement can include rollers 5 and 6 at the two ends of the bed on which are wound a transport sheet 7. By rotating the rollers with electric motors or hand cranks the transport sheet can be moved across the bed to transport a person reclining on the bed, across the surface of the mattress 9.

Also attached to the bed 4 is a lift member 17, by which the mattress 9 can be optionally raised as is known in the art.

The wheelchair 3 has provisions for transferring a person to and from the bed. It contains a frame 14 supported on front wheels 15 and rear wheels 16, all of which are depicted as small in size. Either pair may be on casters or fixed axles, or the front pair may be large with fixed axles with the other pair on casters. The wheelchair back rest 11 is removably mounted to the back of the wheelchair in a known manner. The seat 10 is rotatably mounted on each side to the frame 14 through seat pivots 19 and is connected to the top of the leg rest 12 through a knee hinge 20. The bottom of the leg rest 12 is similarly attached on each side to links 21 through foot pivots 21*a*, and the other ends of links 21 are attached to frame 14 by link pivots 22. The seat 10 is held securely in the normal seating position shown, except during transfer operation. A foot rest 13, is attached to the leg rest 12. Optional arm rests 24 and handles 23 are attached to frame 14. A lever 28 is preferably attached or coupled to the leg rest 12 to enable an attendant to assist a transfer. As will become readily apparent to those skilled in the art, the lever 28 can be attached to the seat or other seat structure provided the lever can be used to cause the leg rest to raise up in a manner so as to effect, or assist in, the transfer of the patient from the chair to the bed.

Figure 1B:
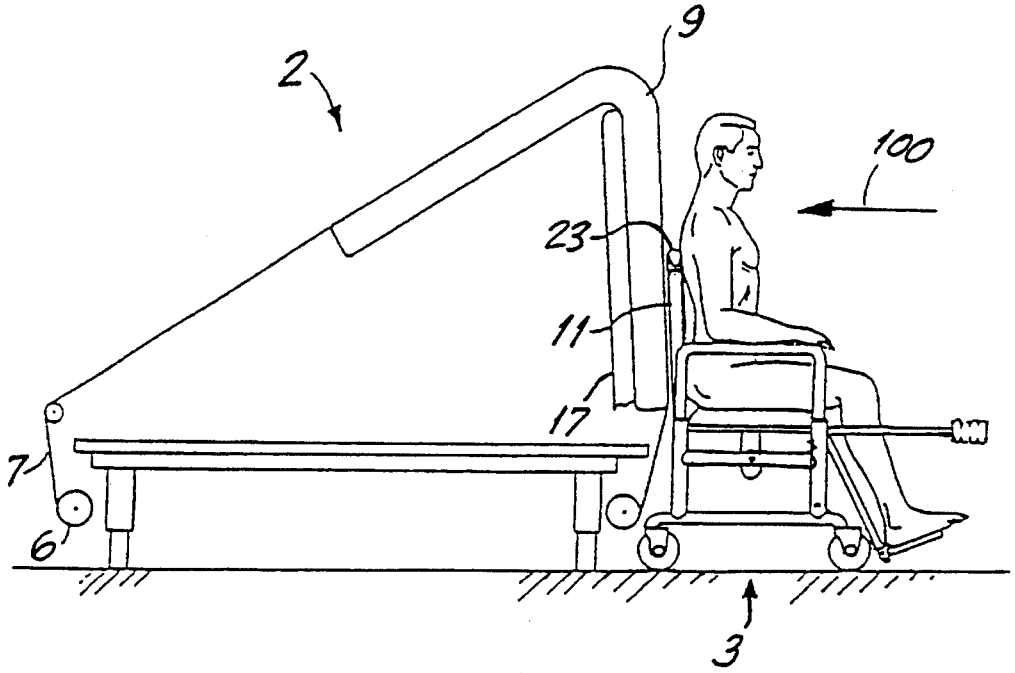

FIG. 1*b* shows the initial transfer steps. The wheelchair 3 has been pushed back, as shown by arrow 100. It is important for safety reasons to secure the position of the wheelchair 3 relative to the bed 2 to prevent the movement of the wheelchair 3 away from the bed 2 during transfer as is known in the art. This is preferably done by latching (not shown) the wheelchair 3 to the end of the bed 2. Alternatively, the wheels can be locked, the wheelchair can be held in place by an attendant, or other securing means can be adopted by those skilled in the art to prevent movement of the wheelchair 3 relative to the bed 2.

The controls (not shown) have been set for control by a transfer attendant and the attendant switch for transferring a person to the bed has been actuated. The lift member 17 has been rotated to lift up the mattress 9 to an almost verticle position, as shown, with the mattress raised and the wheelchair latched in position, the backrest 11 is unlocked (by means not shown) and is then removed. Alternatively, the lift member 17 may be configured to raise the transport sheet 7 instead of raising the mattress as shown in FIGS. 1*b*, 1*c*, and 1*d*.

Figure 1C:
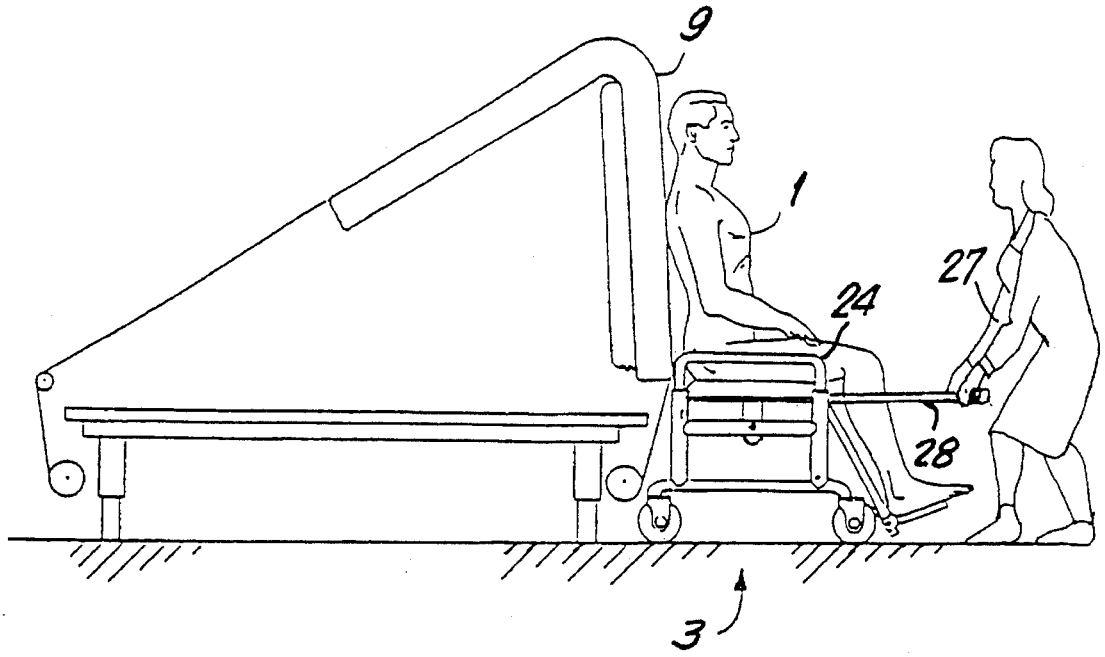

FIG. 1*c* shows the wheelchair 3 with the backrest 11 removed so that the back of the person 1 is supported by the mattress 9. The backrest may be completely removed, as shown, or may be lowered, or pivoted to the side, or otherwise taken out from behind the person's back. An attendant 27 is holding the lever 28, ready to help transfer the patient to the bed.

Figure 1D:
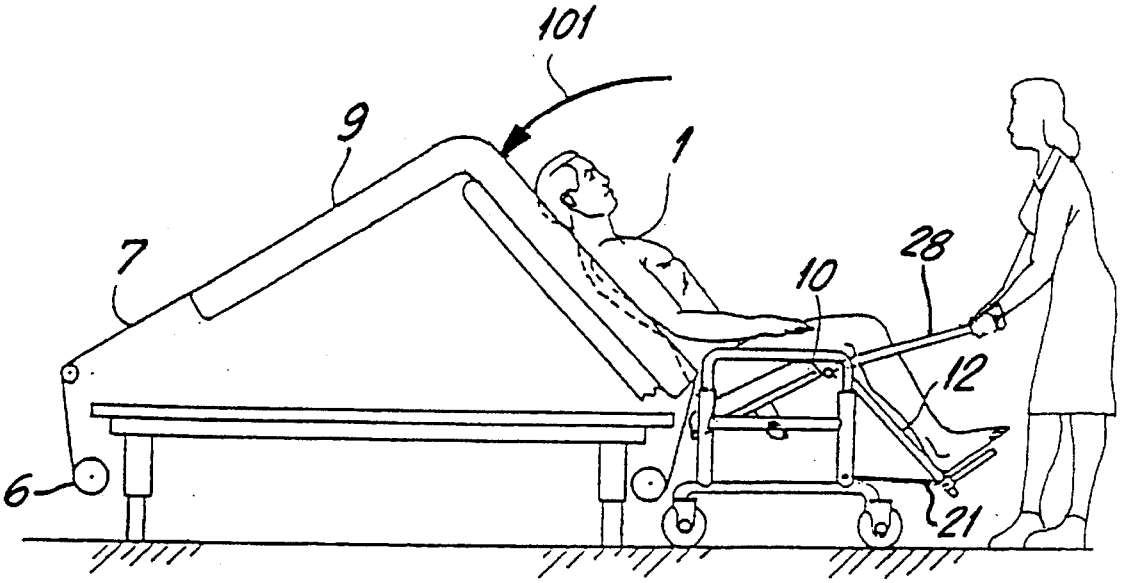

FIG. 1*d* shows the beginning of the actual transfer of the patient by the action of lowering the mattress lift member 17 which lowers the person 1 toward a reclining mattress as shown by arrow 101. As the mattress is lowered, the attendant pulls up the lever 28 to raise the leg rest 12 and to rotate the seat 10 to a preferred angle of approximately 20 degrees. As mattress 9 moves down, the rear roller 6 is driven to take up slack in the transport sheet 7.

Figure 1E:
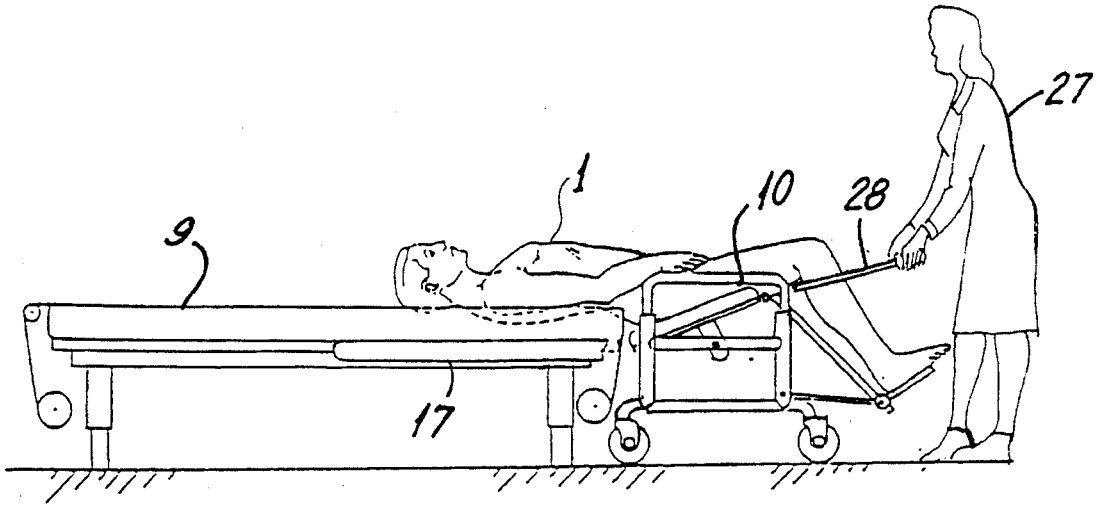

FIG. 1*e* shows the mattress lift member 17 in its lowered position with the person 1 reclining partly on the mattress 9. Preferably, when the mattress drops below approximately 10 degrees of tilt, the sheet 9 starts moving as it is wound on roller 6 and the attendant moves the lever 28 to help the patient onto the bed comfortably, as shown in FIGS. 1*f*, 1*g*, and 1*h*.

Figure 1F:
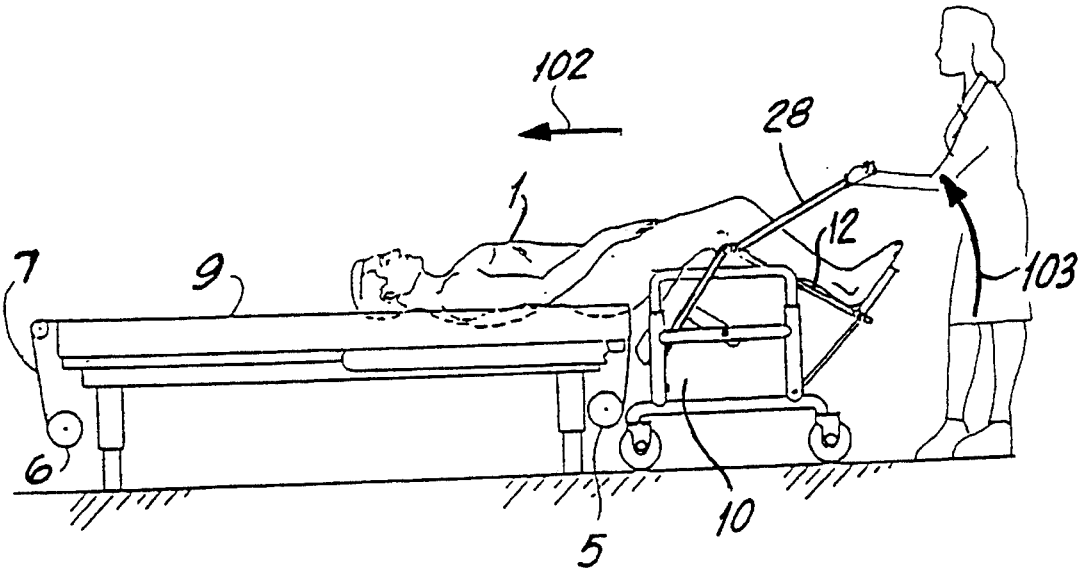

FIG. 1*f* shows, by arrows 102 and 103, the action of the sheet 7 and the rotation action of lever 28 to transfer the person 1 onto mattress 9 as the rear roller 6 is driven to wind up sheet 7 drawing it across the mattress 9 from front roller 5.

Figure 1G:
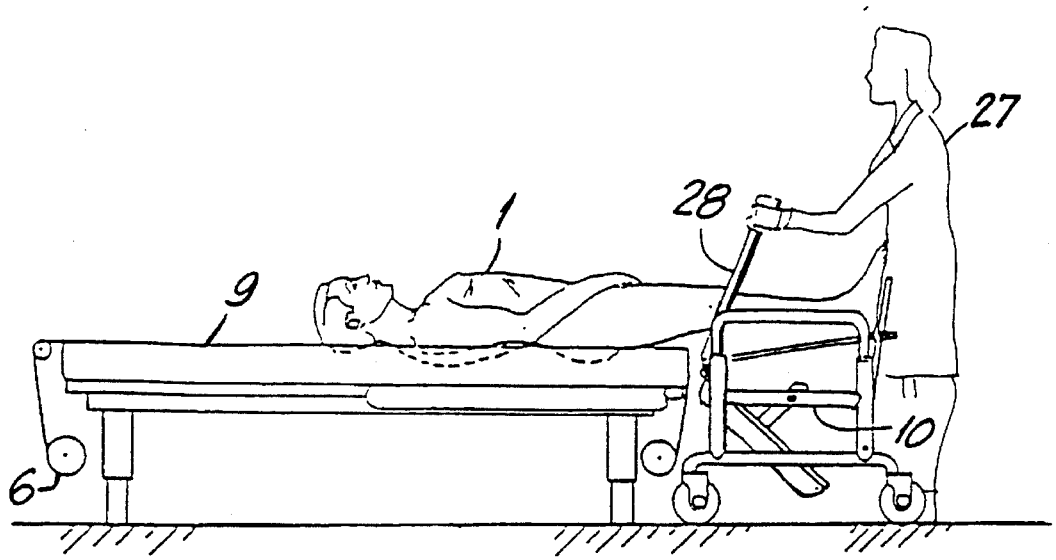

FIG. 1*g* shows the leg rest fully raised. Rear roller 6 continues to move the person 1, with his legs and feet sliding off the leg rest 12 until he reaches the middle of the mattress 9, as shown in FIG. 1*h*. At that point transfer of the person from the wheelchair 3 to the bed 2 is complete.

Figure 1H:
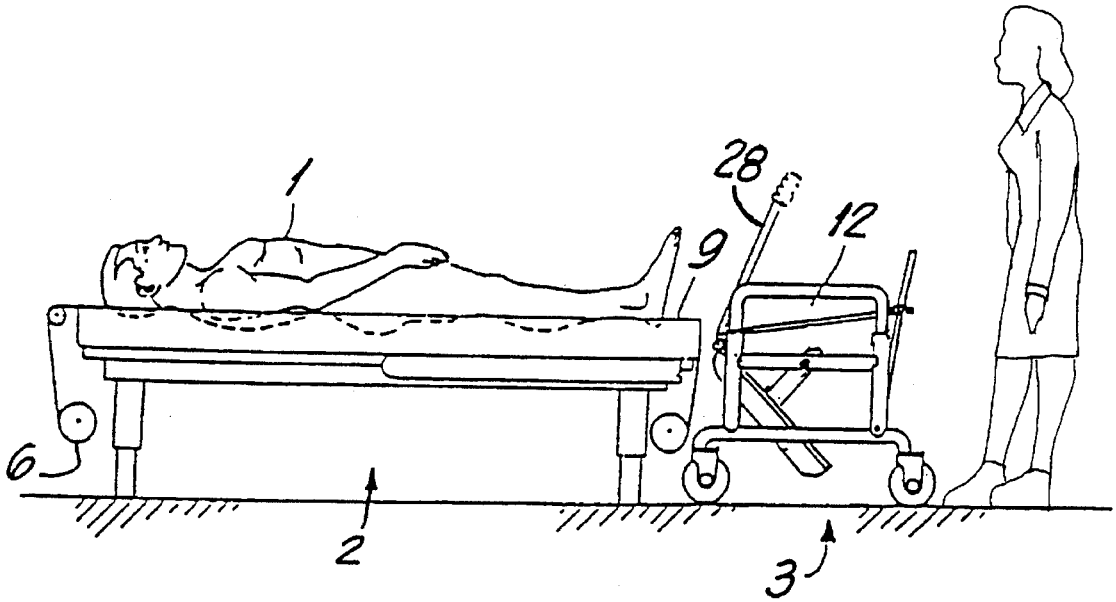

By reversing the directions of all the motions previously described and the order of the above steps, the patient can be transferred back from the bed to the wheelchair as illustrated in FIG. 1*h* sequenced through to FIG. 1*a*. As illustrated in FIG. 1*g*, when the sheet 7 transfers the patient to the wheelchair to the point where the patient's feet touch the foot rest 13, the attendant 27 begins to pull down on the lever 28 to help the patient's feet push down the foot rest until the leg rest is substantially down as in FIG. 1*e*. The mattress 9 is then raised as the sheet 7 is unrolled from the rear roller 6 as shown in FIG. 1*d*. When the mattress is fully up, as shown in FIG. 1*c*, the attendant may release the lever 28 in its fully down position. The backrest can then be installed on the chair and the chair can be released from the bed as shown in FIGS. 1*b* and 1*a*.

The seat pivot 19 as shown in FIG. 1*a* is shown preferably to be located significantly below the seat 10 in order to prevent too large a gap developing between the mattress and the seat as the seat pivots back during a transfer to the bed, as shown in FIGS. 1*d* to 1*f*. In addition, with this location of the pivot, the top of the seat moves forward or back, in the same direction as the patient's buttocks, so as to assist in a transfer and to reduce any relative sliding motion of the buttocks over the seat cushion.

The rotatable seat and leg rest combination as shown in sequence FIGS. 1*b* through 1*h* can be used in an alternate embodiment in configuration with a lowered bed for transfer to the bed and a raised bed for transfer to the chair.

Figure 2:
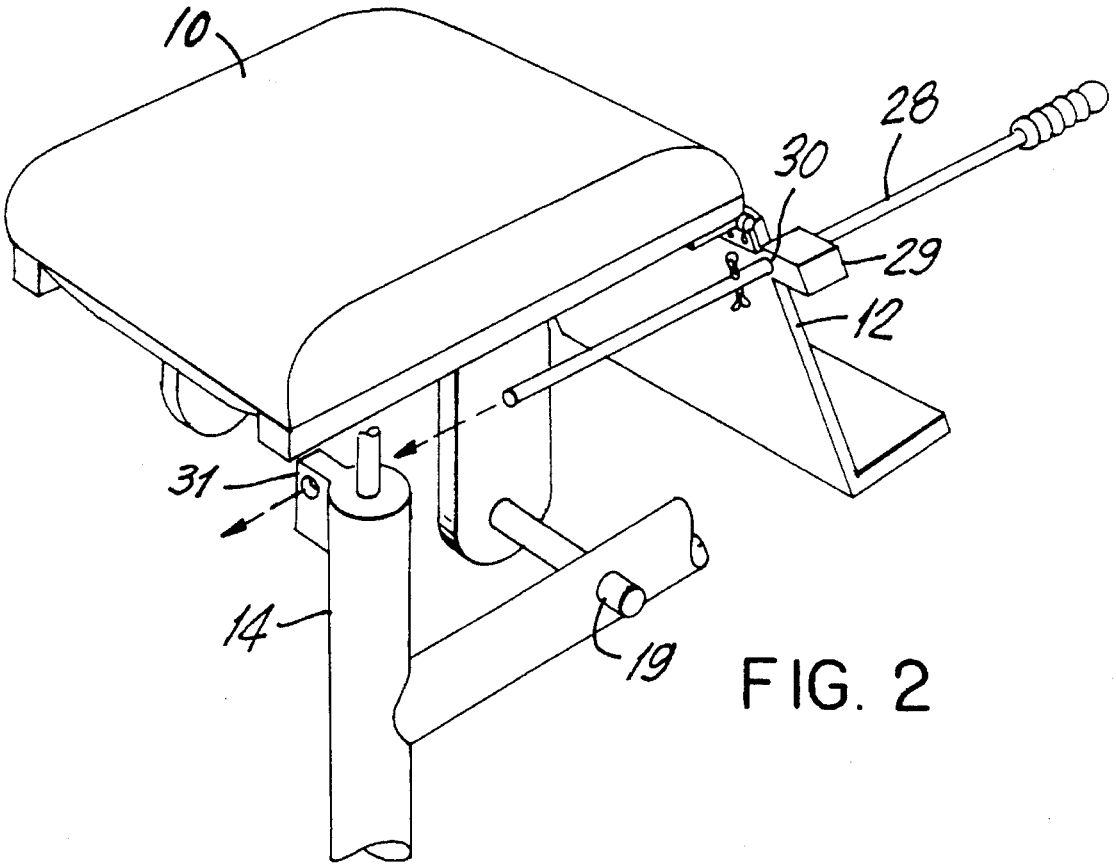
FIG. 2 is a partial perspective view of an embodiment of the invention showing a locking arrangement for a movable seat and leg rest.

FIG. 2 shows an optional preferred locking arrangement whereby the lever 28 can be used to lock the wheelchair 3 in its seating configuration with the seat 10 in a substantially level position and the leg rest slanted down from the seat cushion. The lever 28 extends through a hole 30 in a lever guide 29 which is connected to the leg rest, so that tilting the lever 28 raises or lowers the leg rest 12. When the seat is in substantially a horizontal position, the lever 28 can be pushed toward the back of the wheelchair to project through a locking hole 31 in the wheelchair frame 14, to lock the seat in its sitting position, and to retract the lever to an unobtrusive position.

Figure 3A:
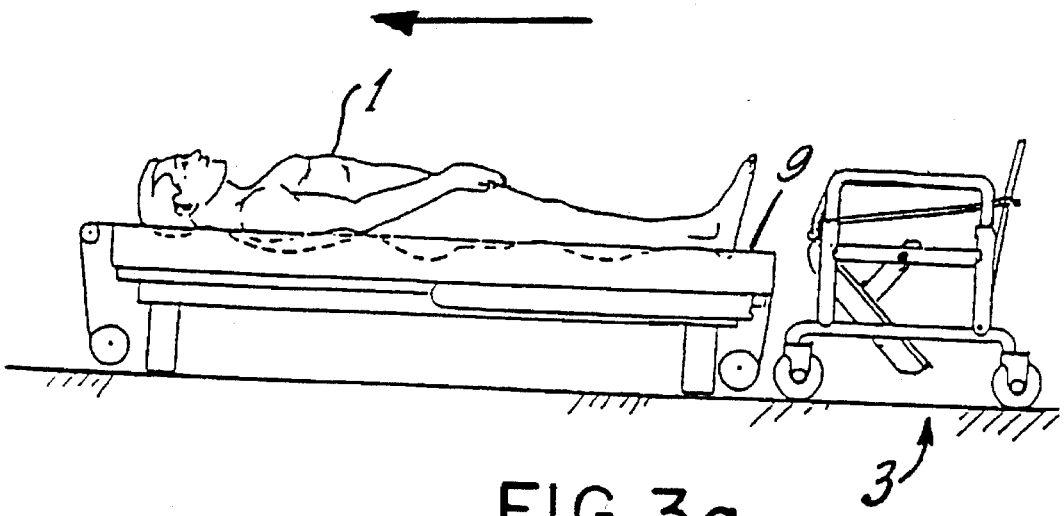
FIGS. 3*a* and 3*b* are schematic views of an embodiment of the invention showing the transfer of a person between a bed and a wheelchair wherein the height of the bed is raised to facilitate transfer from bed to wheelchair and the height of the bed is lowered to facilitate transfer from wheelchair to bed.
Figure 3B:
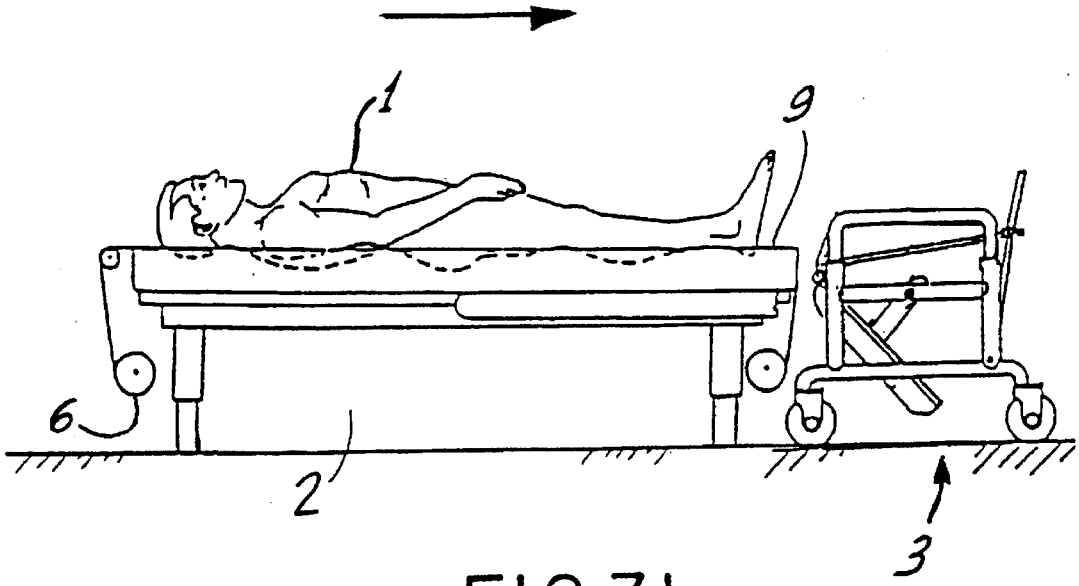

FIGS. 3*a* and 3*b* show schematically an alternative arrangement to facilitate transferring a person from a wheelchair to a bed and back to the wheelchair. In this arrangement as shown in FIG. 3*a*, the bed 2 is lowered for a transfer from the wheelchair 3 to the bed. In FIG. 3*b*, the bed 2 is raised to facilitate a transfer back to the wheelchair 3. By adjusting the height of the bed relative to the wheelchair, the patient can be transferred to or from the wheelchair 3 without assistance. In this arrangement a spring is preferably used to help lift the leg rest and tilt back the seat as shown in the alternate embodiment of FIG. 4.

Figure 4:
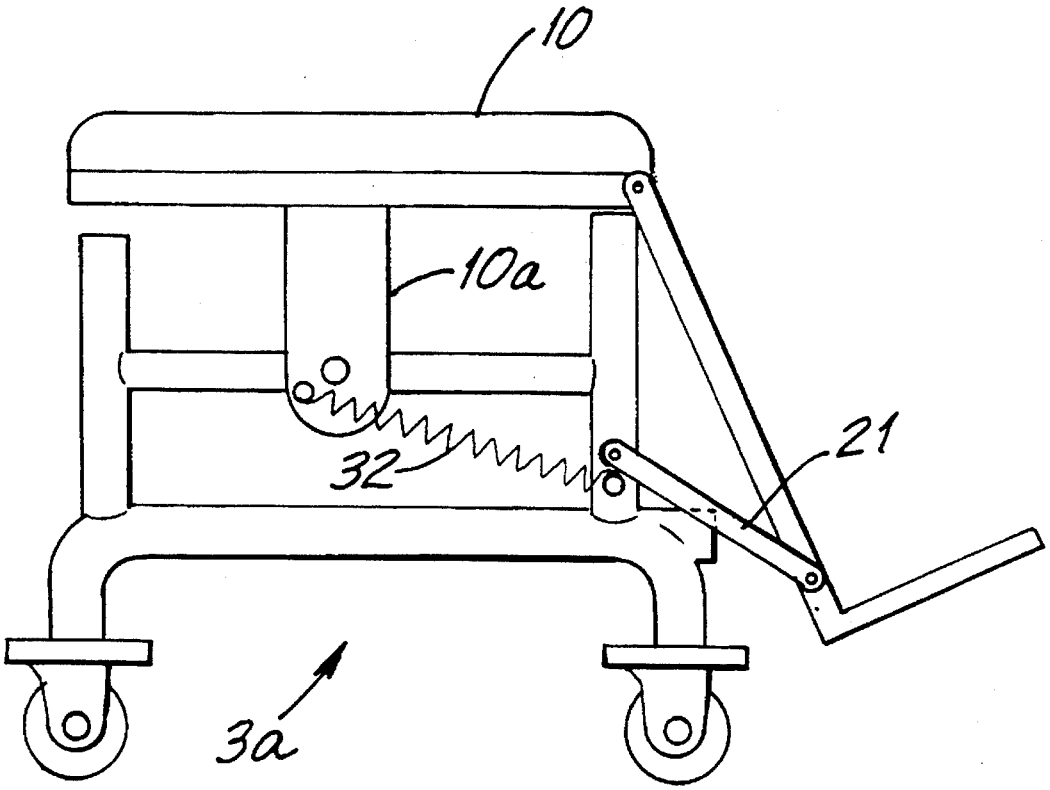
FIG. 4 is a partial side view of an embodiment of the invention showing a chair incorporating a spring device to assist in the transfer of a person from a chair to a bed.

FIG. 4 shows an alternative or supplementary arrangement in which the wheelchair 3*a* is equipped with an extension spring 32 connected between the seat cushion support 10*a* and the wheelchair frame 14. The spring 32 provides a torque which partially supports the weight of the leg rest and a person's legs thereon and thereby facilitates a transfer. As shown, when the seat is in a normal sitting position (not tilted), the spring is stretched in a direction to lift the leg rest and cause the seat to pivot-up. As will become readily apparent to those skilled in the art, the placement and state of the spring (stretched or compressed) is unimportant as long as the spring acts to lift up the leg rest and the patient's legs for transferring the patient from the chair to the bed. This spring force preferably is adjustable, and the spring 32 may include a pneumatic or hydraulic damper, or dashpot with a piston which forces a gas or liquid through a limiting aperture similar to those commonly used on home screen doors to limit the speed of closure.

FIGS. 5*a* to 5*g* show a transfer from a chair 43 to a bed 4, using another embodiment in which the seat 40 is fixed in place on the chair 43 and the bed is lowered for transferring to the bed and raised for transferring to the chair.

Figure 5A:
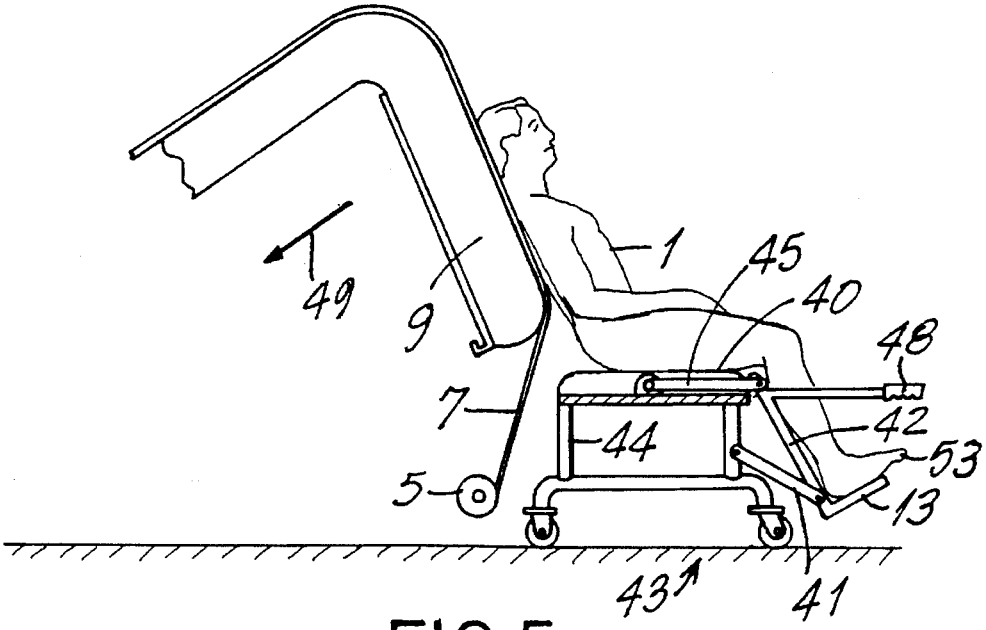
FIGS. 5*a* through 5*g* are schematic sequential views of another embodiment of the present invention showing the transfer with a fixed seat on a wheelchair having a moveable leg rest wherein the height of the bed is raised to facilitate transfer from bed to wheelchair and lowered to facilitate transfer from wheelchair to bed.

FIG. 5*a* schematically shows the patient 1 sitting on the seat 40 which is fastened onto the frame 44 of chair 43 with his feet 53 supported on a foot rest 13. The patient 1 is supported by a mattress 9 which has been raised behind his back. The backrest, not shown has been removed from the wheelchair. The leg rest 42 is pivotally connected to the chair frame 44 through links 41 and 45 in a four bar linkage. A transfer sheet 7 is shown passing over the raised mattress 9 and wound on a front roller 5, which is mounted on the bed 4, as was shown in FIGS. 1*a* and 1*b*. The arrow 49 shows the transfer starting as the mattress moves down. In FIG. 5*a*, the bed is in its lowered position, as indicated by the height of the roller 5 relative to the floor, for facilitating a transfer to the bed.

Figure 5B:
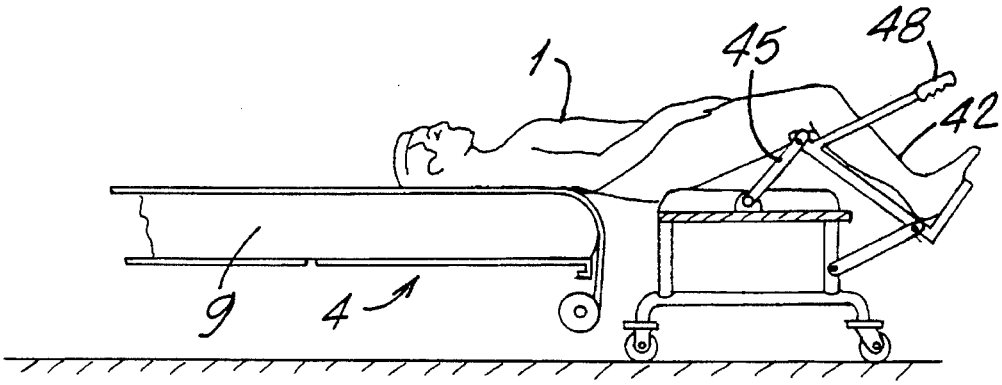
Figure 5C:
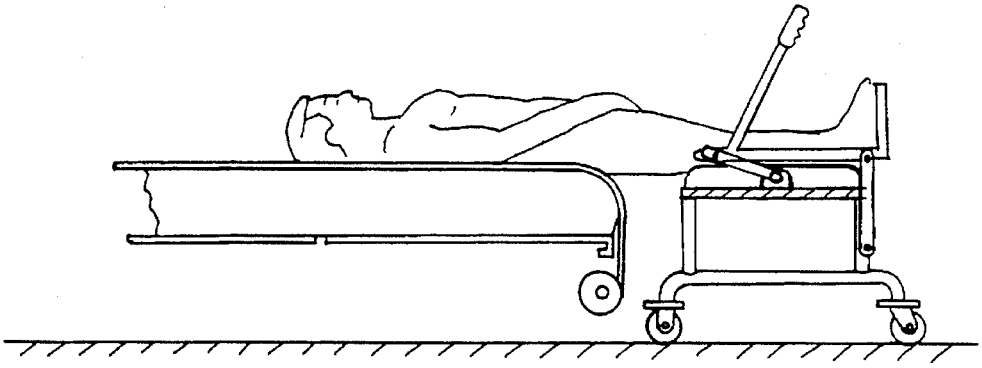
Figure 5D:
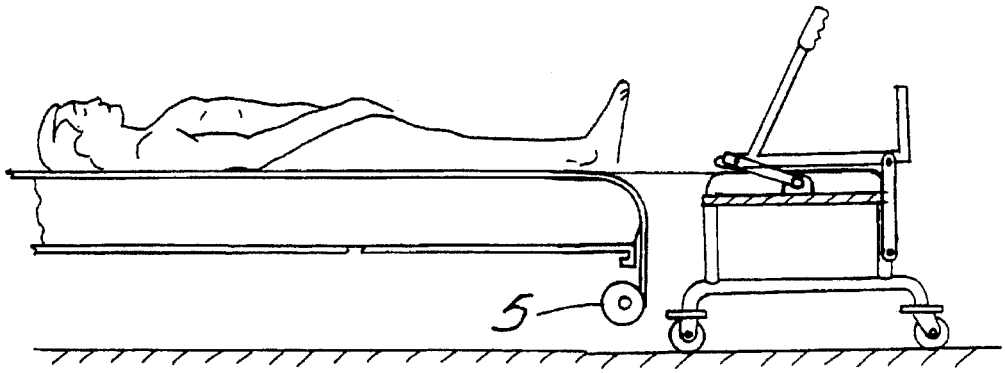

FIG. 5*b* shows the person 1 partly on the lowered mattress 9. The person's legs and buttocks have been raised by the leg rest 42 supported by link 45 and lifted by manual force on the lever 48 by an attendant and by a spring or by the spring alone. With the bed in a lowered position the person is easily pulled onto the bed by the moving sheet 7 as shown in FIGS. 5*c* and 5*d*.

Figure 5E:
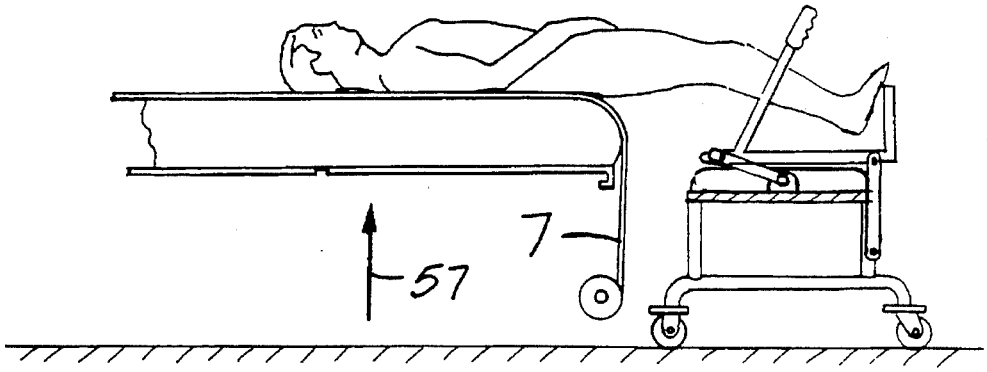
Figure 5F:
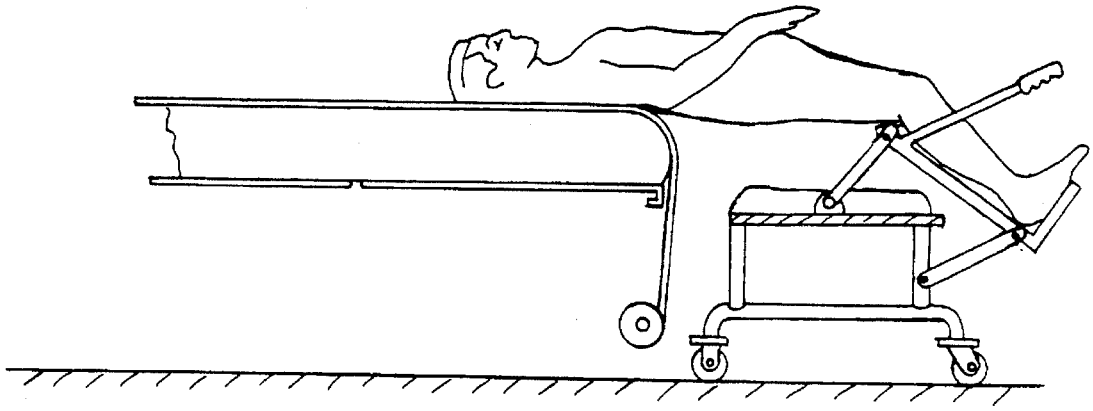
Figure 5G:
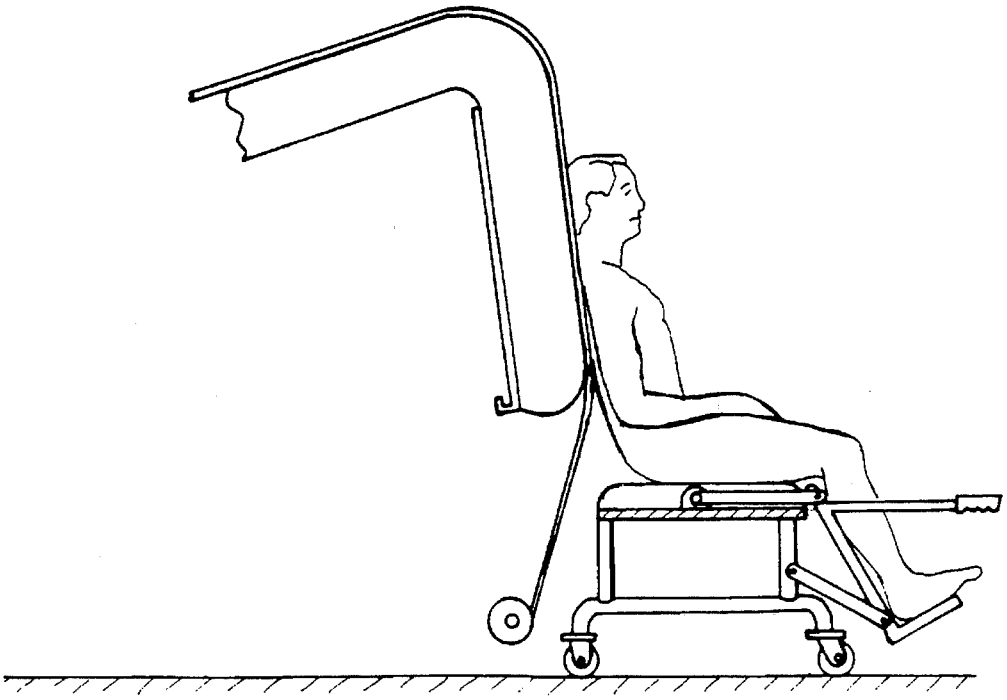

To transfer back to the chair in FIG. 5*e* the bed is raised as shown by the arrow 57 and the roller 5 winds up the sheet 7 to move the patient down onto the chair as shown in FIGS. 5*f* and 5*g*.

An advantage of a fixed seat is that the fixed seat can be converted to a commode seat having a chamber pot for use by a person. Alternatively, this embodiment can use a movable seat.

Figure 6:
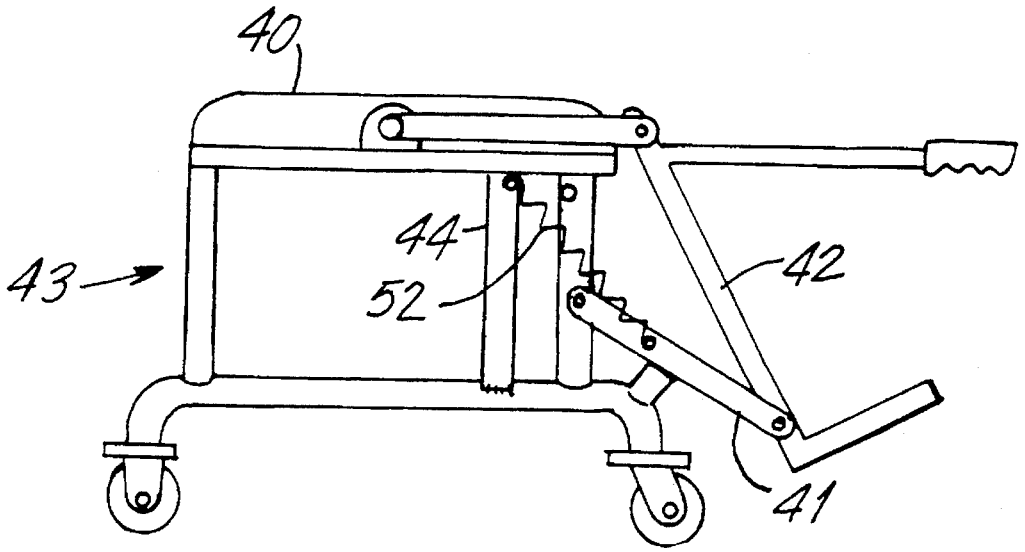
FIGS. 6 and 7 are schematic side views of a wheelchair in accordance with the invention with a fixed seat showing the use of a spring to aid the transfer.
Figure 7:
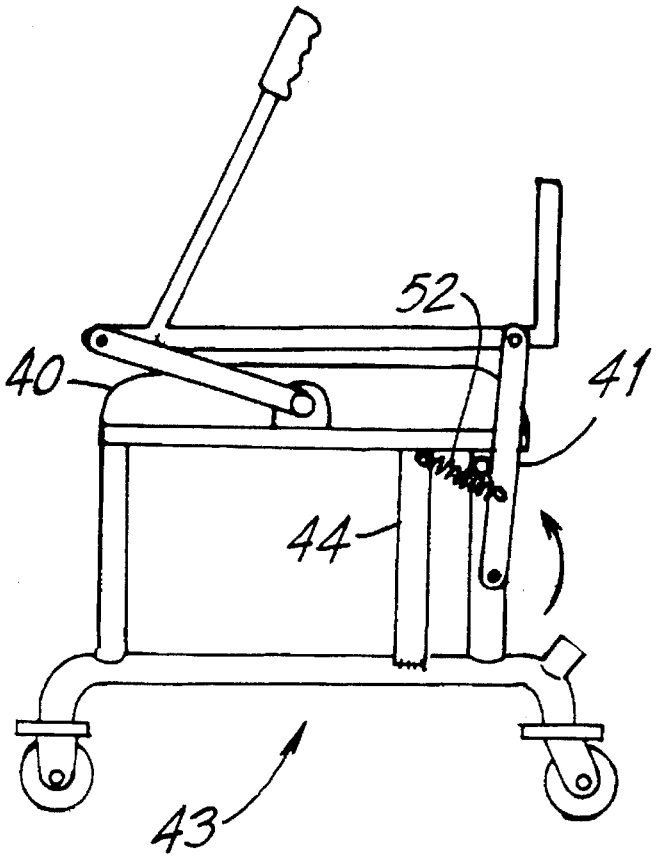

FIGS. 6 and 7 show the wheelchair 43 with a fixed seat 40 and a spring 52 connected between the leg rest 42 and the wheelchair frame 44 for acting to raise the leg rest during a transfer. The spring may also include or be supplemented by a damper or dashpot to limit velocity.

Figure 8:
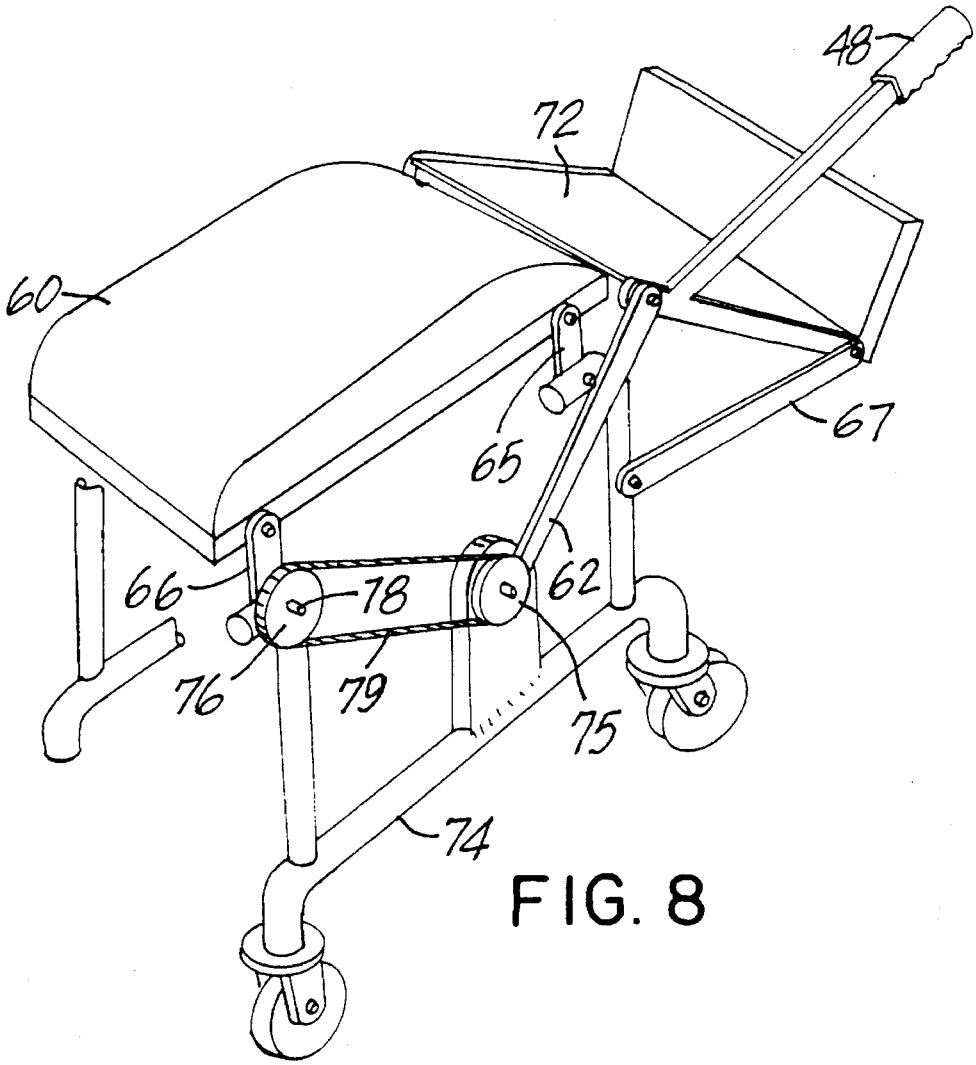
FIG. 8 is a partial schematic perspective view of a further embodiment of the invention wherein the wheelchair seat is lowered as the leg rest is raised.

FIG. 8 shows another wheelchair arrangement in which the seat is lowered as the leg rest is raised. The seat 60 is supported by the two links 65 and 66 pivotally mounted on each side of the wheelchair frame 74. The leg rest 72 is pivotally supported by the links 67 and 62 which are pivotally mounted on each side of the wheelchair frame 74. The sprockets 75 and 76 are rotatably mounted on the frame 74 and are connected by the chain 79. The link 62 is connected to the link 66 through the sprockets 75 and 76, the chain 79 and the shaft 78 whereby motion of the leg rest 72 and the link 62 causes motion of the link 66 and the seat 60, such that as the leg rest 72 is raised from its seating position by use of the lever arm 48 to its transfer position, the seat 60 moves down and toward the back of the wheelchair in the direction in which a patient would be being transferred.

During transfer, this seat motion minimizes or eliminates any sliding action of the buttocks over the seat and permits a lower transfer position for the leg rest in comparison to a fixed seat configuration. This movable seat configuration can be operated with or without lowering and raising the bed during transfer to the bed and to the chair, respectively. Further, as will become readily apparent to those skilled in the art, the seat remains in a substantially level position throughout the transfer. Accordingly, an optional commode seat and chamber pot can be used without risk of spillage.

Figure 9:
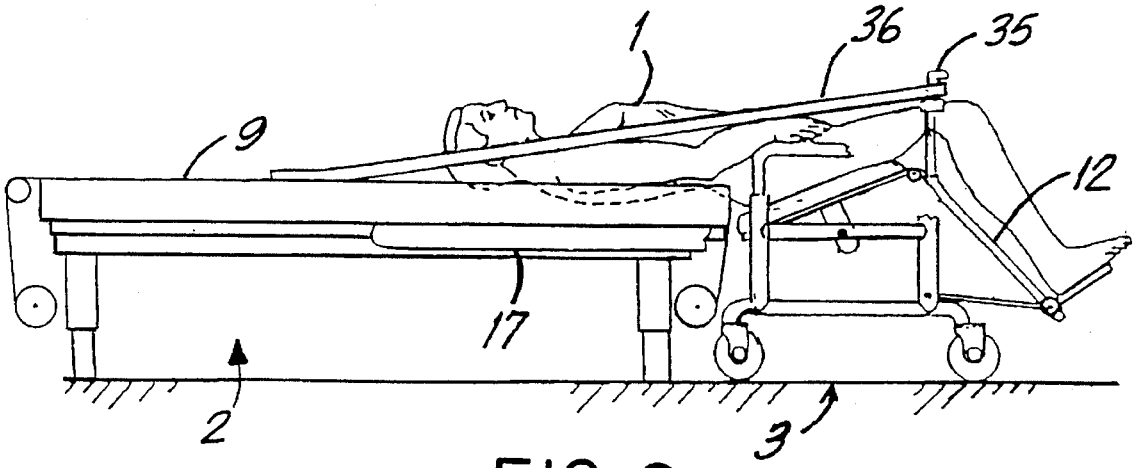
FIG. 9 is a schematic side view of an embodiment of the invention showing a transfer sheet having a pull line connected to a lever arm attached to a moveable leg rest on a wheelchair.

FIG. 9 shows another arrangement which may be used in place of the attendant in FIGS. 1*c*, 1*d*, 1*e* and 1*f*. The wheelchair 3 has a leg rest 12 which is removably connected to a pull line 36 through a pull bracket or lever 35 which is fastened to the leg rest. The other end of the pull line is attached to the transfer sheet 9, or otherwise coupled to the sheet roller 6 so that when the sheet 9 is moved toward the head of the bed by being wound on the head roller 6 the pull line 36 pulls up the leg rest, and thereby helps to move the patient 1 onto the bed 2. The pull line 36 may be permanently attached to the transfer sheet or, removably fastened to the conveyor sheet by hook-and-loop fastening material or other means. This pull line arrangement may be used on either or both sides of the bed.

As will become readily apparent to those skilled in the art, although the illustrations in the present drawing and the above description describe use of the novel patient transfer system with a wheelchair, any chair, bench or other seat device can be used provided they assist in transferring of a patient from a chair to a bed as described above. Further, the various features described above can be used alone or in combination with other features without departing from the scope of the invention set forth below in the claims.

What is claimed is:

1. A chair-bed transfer arrangement, comprising:

a) a bed including:
   i) a head end and a foot end;
   ii) a mattress;
   iii) a head-end roller at the head end of the bed;
   iv) a foot-end roller at the foot end of the bed;
   v) a transfer sheet extending across the mattress and wound on each roller;

b) a chair positioned at the foot end of the bed, the chair having a seat and a movable leg rest and the seat movably mounted on the chair; and c) a lever attached to the leg rest to enable the leg rest to be raised to transfer a person from the seat to the bed; and d) at least one roller drive attached to at least one roller to cause the head-end roller to wind and the foot-end roller to unwind the transfer sheet so as to assist in the transfer of the person from the seat to the bed.

2. A chair-bed transfer arrangement as in claim 1 wherein the chair includes a spring to help raise the leg rest and further assist in the transfer of the person from the seat to the bed.

3. A chair-bed transfer arrangement as in claim 2 wherein the chair is a wheelchair.

4. A chair-bed transfer arrangement as in claim 2 wherein the chair is a commode.

5. A chair-bed transfer arrangement as in claim 3 wherein the wheelchair can be converted into a commode.

6. A chair-bed transfer arrangement as in claim 1 wherein the leg rest is connected to the transfer sheet so that winding the transfer sheet on the head-end roller moves the leg rest so as to assist in the transfer of the person from the seat to the bed.

7. A chair-bed transfer arrangement as in claim 1 wherein the lever can be moved manually to assist in the transfer from the seat to the bed.

8. A chair-bed transfer arrangement as in claim 1 wherein the seat is pivotably mounted to the chair by a pivot positioned below the seat.

9. A chair-bed transfer arrangement as in claim 1 wherein the seat is connected to the leg rest so that the motion of the leg rest is accompanied by the motion of the seat.

10. A method for transferring a person on a chair to a bed, wherein the chair has a movable leg rest with a lever and the bed has a transfer sheet, comprising the steps of:

a) positioning the chair at an end of the bed;

b) moving the lever to raise the leg rest and transfer the person from the chair to the bed; and c) moving the transfer sheet to further assist in the transfer of the person from the chair to the bed.

11. A method of transferring a person from a chair to a bed as in claim 10 wherein the chair has a movable seat and wherein the lever moving step also causes the seat to move and further assist in the transfer of the person from the seat to the bed.

12. A method for transferring a person on a chair to a bed as in claim 10, further comprising the step of:

d) lowering the bed to further assist in the transfer.

13. A method for transferring a person on a chair to a bed, wherein the chair has a movable leg rest with a lever and a movable seat and the bed has a transfer sheet, comprising the steps of:

a) positioning the chair at an end of the bed;

b) moving the lever to raise the leg rest and transfer the person from the chair to the bed;

c) moving the seat in response to moving the lever to further assist in the transfer; and d) moving the transfer sheet to further assist in the transfer.

14. A method for transferring a person on a chair to a bed, wherein the bed has a transfer sheet, the chair has a movable leg rest with a lever and the transfer sheet is connected to the lever, comprising the steps of:

a) positioning the chair at an end of the bed;

b) moving the lever to raise the leg rest and transfer the person from the chair to the bed, wherein the lever moving step is performed at least in part by moving the transfer sheet.

15. A method for transferring a person on a bed to a chair, the chair having a movable leg rest in a raised position and the leg rest having a lever, comprising the steps of:

a) positioning the chair at an end of the bed;

b) moving the person so that the legs of the person are on the raised leg rest;

c) moving the lever to lower the leg rest and transferring the person from the bed to the chair; and d) raising the back of the person.

* * * * *